United States Patent [19]

Frear

[11] 4,394,058

[45] Jul. 19, 1983

[54] ELECTRICAL CONNECTOR INSERT ASSEMBLY

[75] Inventor: David L. Frear, Afton, N.Y.

[73] Assignee: The Bendix Corporation, Southfield, Mich.

[21] Appl. No.: 279,139

[22] Filed: Jun. 30, 1981

[51] Int. Cl.[3] ..... H01R 13/42

[52] U.S. Cl. ..... 339/59 R

[58] Field of Search ..... 339/59 R, 59 M, 217 S

[56] References Cited

U.S. PATENT DOCUMENTS

| | | | |
|---|---|---|---|
| 3,101,229 | 8/1963 | Yopp | 339/59 M |
| 3,158,424 | 11/1964 | Bowen . | |
| 3,165,369 | 1/1965 | Maston . | |
| 3,747,047 | 7/1973 | Carter et al. | 339/59 M |
| 3,812,447 | 5/1974 | Eifler et al. | 339/59 R |
| 3,824,681 | 7/1974 | Clark | 339/90 C |
| 4,023,880 | 5/1977 | Powell | 339/59 R |

*Primary Examiner*—Mark Rosenbaum

*Attorney, Agent, or Firm*—Raymond J. Eifler

[57] ABSTRACT

The invention is an electrical connector assembly of the type having a housing (15); a rubber moisture sealing grommet (20) and a contact retaining insert (10) characterized by a plurality of passages (15) that contain a plurality of pivotally mounted (13) and radially deflectable arcuate segments (11) that include on the inside thereof a radially inwardly projecting shoulders (12) that engage a groove (32) of a contact (30) located in a passage (15). A tool may be inserted into the passage to pivot the arcuate segments (11) so that the shoulders (12) disengage the groove (32) in the contact (30) thereby releasing the contact (30) for removal from the passage (15).

8 Claims, 5 Drawing Figures

ELECTRICAL CONNECTOR INSERT ASSEMBLY

This invention relates to electrical connectors having front or rear releasable and front or rear removable contacts and more particularly to the contact retaining mechanism within the connector.

Electrical connectors generally include a plug and a receptacle, each of which has an insert of dielectric material provided with multiple openings within which electrical contacts are releasably retained. Examples of electrical connectors that have rear releasable and rear removable contacts may be found in U.S. Pat. Nos. 3,165,369 issued Jan. 12, 1965 and entitled, "Retention System for Electrical Contacts"; 3,158,424 issued Nov. 24, 1964 and entitled, "Contact Mounting";l and 3,824,681 issued July 23, 1974 and entitled, "Method of Providing a Coupling for Electrical Connectors and the Like". Connectors of this type allow contacts to be removed from the rear of a connector while it is still connected to another connector. An example of another type of electrical connector that has front releasable and front removable contacts as well as rear releasable and rear removable contacts may be found in U.S. Pat. No. 4,082,398 issued Apr. 4, 1978 and entitled, "Electrical Connector with Front and Rear Insertable and Removable Contacts". Finally, an example of an electrical connector of the type having front releasable and rear removable contacts may be found in U.S. Pat. No. 3,221,292 issued Nov. 30, 1960 and entitled "Electrical Connector". This last type of connector makes it easier to identify the contact to be removed since identification of the contact is located in the front face of the connector.

None of the foregoing connectors provide a connector that permits front or rear release of a contact that can be removed from either the rear or front of a connector.

DISCLOSURE OF THE INVENTION

This invention provides an electrical connector having contacts that may be released from either the front or the rear of the connector for removal from either the front or rear of the connector.

The invention is an electrical connector of the type having a housing, a plurality of contacts, and means for mounting the contacts in the housing characterized by an insert having a plurality of passages each of which contains two pivotally mounted arcuate segments each having an inwardly projecting shoulder that engages a groove in the middle portion of a respective contact. By pivoting the arcuate segments outwardly with a tool a contact may be released for removal from the insert.

One advantage of this invention is that it provides the option of releasing and removing a contact from either the front or the rear of a connector.

DETAILED DESCRIPTION OF THE INVENTION

Figure 1:
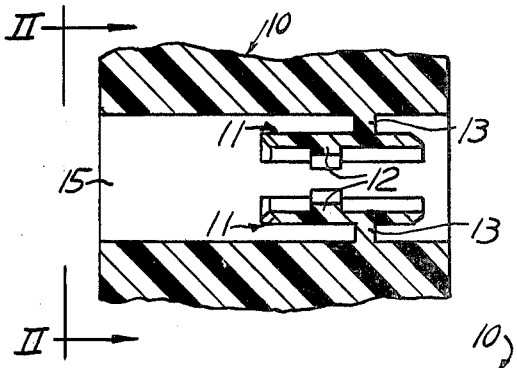
FIG. 1 illustrates a portion of a contact retaining insert incorporating the principles of this invention.

Referring now to the drawing, FIG. 1 is a partial view of an insert 10 illustrating one of a plurality of passages 15 each containing two arcuate segments 11 for retaining a contact (not shown). The insert 10 and the arcuate segments 11 are a one-piece body molded from a dielectric material, e.g. a polyamide such as Torlon. Each of the arcuate segments 11 include an internal shoulder 12 which projects inwardly. The arcuate segments 11 being integrally connected to the wall of the passageway 15 in the insert 10 by a connecting member 13 which allows the arcuate segments 11 to pivot inwardly and outwardly from the connecting member 13. The inwardly projecting shoulders 12 are axially spaced from the connecting member 13.

Figure 2:
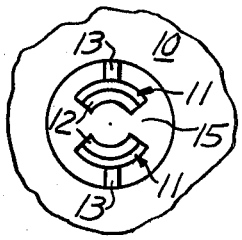
FIG. 2 illustrates end view of the insert.

FIG. 2 is a partial view of the arcuate segments 11 taken along lines II—II in FIG. 1. This view illustrates that the member 13 connecting the arcuate segments 11 to the main body of the insert 10.

Figure 3:
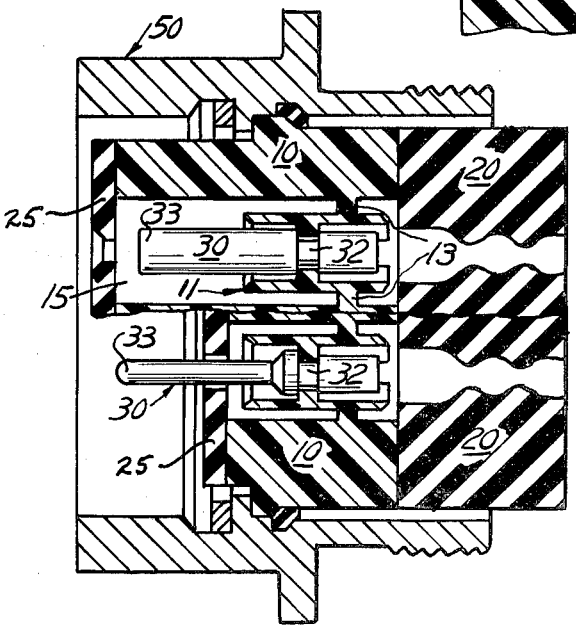
FIG. 3 illustrates an electrical connector incorporating the principles of this invention.

FIG. 3 illustrates a diagrammatic view of an electrical connector having male and female contacts 30 mounted therein. The electrical connector is generally comprised of an outer metal shell 50; a contact retaining insert 10 mounted within the connector shell 50; a rear moisture sealing grommet 20; and a forward interfacial seal 25 generally comprised of rubber.

Figure 4:
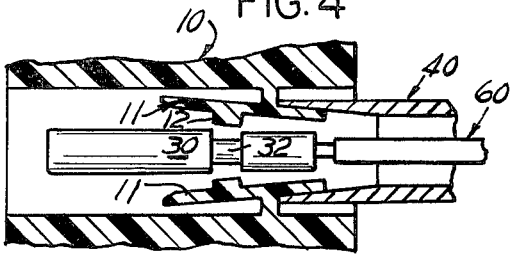
FIG. 4 illustrates a contact being released from one end of the insert for removal from the insert.

FIG. 4 illustrates how a contact 30 may be released from the contact retaining insert 10 for removal from either end of the insert 10. A tool 40 is inserted into either end of the insert 10 and around the outside of the arcuate segments 11 to deflect the segments 11 so that the contact 30 is released for removal from either end of the insert 10 by pulling on the wire 60 attached to the contact 30 or by pushing on the wire 60. Once the tool 40 is removed the deflected segments 11 return to their original position.

Figure 5:
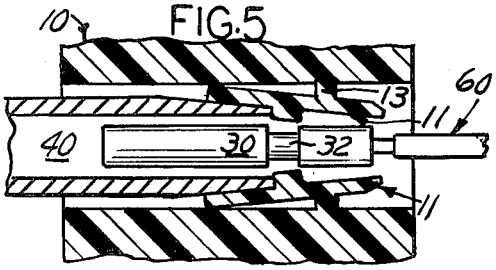
FIG. 5 illustrates a contact being released from the other end of the insert for removal from the insert.

FIG. 5 illustrates how a contact 30 may be released from either end of the insert 10 by inserting the tool 40 into either end of the insert 10 and inside the arcuate segments 11 to deflect the segments 11. Again, the contact 30 may be removed from the insert 10 either by pulling or pushing on the wire 60.

While a preferred embodiment of the invention has been disclosed, it will be apparent to those skilled in the art that changes may be made to the invention as set forth in the appended claims, and in some instances, certain features of the invention may be used to advantage without corresponding use of other features. For instance, the number of arcuate segments for retaining a contact within the insert could be changed. Accordingly, it is intended that the illustrative and descriptive materials herein be used to illustrate the principles of the invention and not to limit the scope thereof.

Having described the invention what is claimed is:

1. In combination with an electrical connector having removable contacts said connector of the type having: a housing; a plurality of contacts, each contact having a rear portion, a forward mating portion, and an annular groove between said forward and rear portions, and means for releasably mounting said contacts in said housing including an insert having a plurality of bores therein, each bore having therein a portion of a respective contact having the annular groove therein and a contact retention member, the improvement wherein said contact retention member comprises:

an arcuate segment having forward and rear ends spaced from the wall of said bore and on the inside thereof an inwardly projecting shoulder engaging the annular groove in a respective contact, and on the outside thereof between said ends, means for pivotally mounting to said insert the arcuate segment in each bore so that either end of said arcuate segment may be deflected to disengage the projecting shoulder from the groove in the contact whereby, a tool may be inserted into a bore in said insert to engage and pivot said arcuate segment in said bore so that the projecting shoulder of the segment disengages from the groove in the contact thereby releasing the contact in said bore for removal from the connector.

2. The combination as recited in claim 1 wherein there are at least two arcuate segments in each bore.

3. In combination with an electrical connector having removable contacts, said connector of the type having a housing; a plurality of contacts, each contact having a rear portion, a forward mating portion, and an annular groove between said forward and rear portions; an insert having a plurality of bores each having a rear portion of a respective contact therein; and means for releasably mounting said contacts in a respective bore, said means including a plurality of contact retaining members in each of said bores, the improvement wherein each of said contact retaining members comprises:

an arcuate segment having forward and rear ends spaced from the wall of said bore and on the inside thereof an inwardly projecting shoulder engaging the annular groove in a contact in the bore, and on the outside thereof, means for pivotally mounting to said insert the arcuate segment in each bore so that either end of said arcuate segment may be deflected whereby, a tool may be inserted into a bore in said insert to engage and pivot said arcuate segment in said bore thereby releasing a contact in said bore for removal from the connector.

4. The electrical connector recited in claim 3 wherein said means for pivotally mounting each of said contact retention members is a radially extending connecting member located between the ends of the segments and integral with the outside of said arcuate segment at one end and integral at the other end with the wall of the bore in the insert.

5. The electrical connector recited in claim 3 wherein said connecting member is axially displaced from said shoulder of said segment.

6. In combination with an electrical connector having removable contacts said connector of the type having: a housing; a plurality of contacts, each contact having a rear portion, a forward mating portion, and an annular groove between said forward and rear portions, and means for releasably mounting said contacts in said housing including an insert having a plurality of bores therein, each bore having therein a portion of a respective contact having the annular groove therein and a plurality of contact retention members in each bore, the improvement wherein:

each of said retention members having forward and rear free ends spaced from the wall of said bore and on the inside thereof an inwardly projecting shoulder engaging the annular groove in a respective contact; and means for pivotally mounting said contact retention members in a respective bore of said insert so that either free end of said retention members may be deflected whereby, a tool may be inserted into a bore to engage and pivot said members thereby releasing a contact in the bore for removal from the connector.

7. The electrical connector recited in claim 6 wherein said means for pivotally mounting each of said contact retention members is a radially extending connecting member having one end integral with the outer surface of said member and an opposite end integral with the wall of the bore in the insert.

8. In combination with an electrical connector having removable contacts said connector of the type having: a housing; a plurality of contacts, each contact having a rear portion and a forward mating portion, and means for releasably mounting said contacts in said housing including an insert having a plurality of bores therein, each bore having therein a portion of a respective contact, and a plurality of contact retention members in each bore, the improvement comprising:

an annular groove in each one of one of said contacts and said retention members;

each of said retention members having forward and rear free ends spaced from the wall of said bore;

a radially tapered annular shoulder in each one of the other of said contacts and retention members engaging the annular groove; and means for pivotally mounting said contact retention members in a respective bore of said insert so that either of said forward and rear free ends are deflectable whereby, a tool may be inserted into a bore to engage and pivot said members thereby releasing a contact in the bore for removal from the connector.

* * * * *